US010012111B2

(12) United States Patent
Hurst et al.

(10) Patent No.: US 10,012,111 B2
(45) Date of Patent: Jul. 3, 2018

(54) SHROUD SEGMENT RETAINER

(71) Applicant: ROLLS-ROYCE PLC, London (GB)

(72) Inventors: Andrew James Hurst, Derby (GB); Mark John Simms, Derby (GB)

(73) Assignee: ROLLS-ROYCE plc, London (GB)

( * ) Notice: Subject to any disclaimer, the term of this patent is extended or adjusted under 35 U.S.C. 154(b) by 309 days.

(21) Appl. No.: 14/844,769

(22) Filed: Sep. 3, 2015

(65) Prior Publication Data

US 2016/0090866 A1 Mar. 31, 2016

(30) Foreign Application Priority Data

Sep. 26, 2014 (GB) ..... 1417028.6

(51) Int. Cl.
*F01D 11/08* (2006.01)
*F01D 25/24* (2006.01)
(Continued)

(52) U.S. Cl.
CPC ..... *F01D 25/246* (2013.01); *F01D 5/02* (2013.01); *F01D 9/02* (2013.01); *F01D 11/08* (2013.01);
(Continued)

(58) Field of Classification Search
CPC . F01D 9/02; F01D 5/02; F01D 25/246; F01D 25/28; F01D 11/08; F05D 2220/32;
(Continued)

(56) References Cited

U.S. PATENT DOCUMENTS 4,815,933 A 3/1989 Hansel et al.
5,188,507 A * 2/1993 Sweeney ..... B23H 9/10 415/170.1
2016/0040547 A1* 2/2016 Clouse ..... F01D 25/246 60/805

FOREIGN PATENT DOCUMENTS

EP 2 696 037 A1 2/2014
WO 2014/168804 A1 10/2014

OTHER PUBLICATIONS

Feb. 16, 2016 Search Report issued in European Patent Application No. 15 18 3623.

(Continued)

*Primary Examiner* — Laert Dounis
*Assistant Examiner* — Kelsey Stanek
(74) *Attorney, Agent, or Firm* — Oliff PLC

(57) ABSTRACT

A gas turbine, including: axially adjacent first and second components each having a gas path facing surface within an engine casing, inter-component cavity located between first and second components on the gas path outboard side, an axial-restrictor within the inter component cavity for restricting movement of the first or second component relative to at least one other first and second component or engine casing, wherein the axial-restrictor is radially located in the engine casing or other first and second component and includes a radially facing surface; a retaining element, including a body having circumferential length extending around the gas turbine engine and axial length extending between axially adjacent first and second components when in use; an obstructing portion between the radially facing surface of the axial-restrictor and opposing second radial surface of the other first or second component or engine casing to restrict radial movement of in use axial-restrictor.

15 Claims, 2 Drawing Sheets

(51) Int. Cl.
*F01D 5/02* (2006.01)
*F01D 9/02* (2006.01)
*F01D 25/28* (2006.01)

(52) U.S. Cl.
CPC ..... *F01D 25/28* (2013.01); *F05D 2220/32* (2013.01); *F05D 2240/10* (2013.01); *F05D 2240/11* (2013.01); *F05D 2250/61* (2013.01); *F05D 2260/30* (2013.01)

(58) Field of Classification Search
CPC ..... F05D 2240/10; F05D 2240/11; F05D 2250/61; F05D 2260/30
USPC ..... 415/173.3, 173.1
See application file for complete search history.

(56) References Cited

OTHER PUBLICATIONS

Mar. 17, 2015 Search Report issued in British Patent Application No. 1417028.6.

* cited by examiner

SHROUD SEGMENT RETAINER

TECHNICAL FIELD OF INVENTION

This invention relates to an element for retaining the shroud segment within a gas turbine engine. More particularly, the invention relates to a retaining element which helps prevent the removal of an axial restrictor. In some embodiments, the retaining element may include further features or elements which provide additional functional benefits. These features may include an anti-fret portion and a sealing cavity portion.

BACKGROUND OF INVENTION

FIG. 1 shows a ducted fan gas turbine engine 10 comprising, in axial flow series: an air intake 12, a propulsive fan 14 having a plurality of fan blades 16, an intermediate pressure compressor 18, a high-pressure compressor 20, a combustor 22, a high-pressure turbine 24, an intermediate pressure turbine 26, a low-pressure turbine 28 and a core exhaust nozzle 30. A nacelle 32 generally surrounds the engine 10 and defines the intake 12, a bypass duct 34 and a bypass exhaust nozzle 36.

Air entering the intake 12 is accelerated by the fan 14 to produce a bypass flow and a core flow. The bypass flow travels down the bypass duct 34 and exits the bypass exhaust nozzle 36 to provide the majority of the propulsive thrust produced by the engine 10. The core flow enters in axial flow series the intermediate pressure compressor 18, high pressure compressor 20 and the combustor 22, where fuel is added to the compressed air and the mixture burnt. The hot combustion products expand through and drive the high, intermediate and low-pressure turbines 24, 26, 28 before being exhausted through the nozzle 30 to provide additional propulsive thrust. The high, intermediate and low-pressure turbines 24, 26, 28 respectively drive the high and intermediate pressure compressors 20, 18 and the fan 14 by interconnecting shafts 38, 40, 42.

The main gas path within the high, intermediate and low pressure turbines is bounded by a series of axially adjacent components. These will typically be seal segments which sit radially outboard of the rotating blades, and so-called platforms which are located radially outboard and often integral with nozzle guide vanes. These axially adjacent components experience axial and radial loads and relative movement in use and also need to be sealed across to prevent excessive leakage of air into the main gas path.

U.S. Pat. No. 5,188,507 shows a turbine shroud formed by a ring of butted shroud segments. Each turbine shroud segment has a radially inwardly projecting annular flange which is seated on a radially outwardly facing surface of an annular tip of the outer shroud of the downstream nozzle stage. This flange is free to slide axially relative to the annular tip during thermal expansion of the nozzle outer shroud in the axial direction. Each turbine shroud segment has a spring seated thereon which urges the radially inwardly projecting flange toward the annular tip of the nozzle outer shroud.

WO2014/168804 a blade outer air seal (BOAS) for a gas turbine engine. The BOAS includes a seal body having a radially inner face and a radially outer face that axially extend between a leading edge portion and a trailing edge portion. A retention flange extends from one of the leading edge portion and the trailing edge portion and a seal contacts the retention flange.

The present invention seeks to address one or more of these issues.

STATEMENTS OF INVENTION

The present invention provides a gas turbine and axial restrictor according to the appended claims.

Described below is a gas turbine, comprising: axially adjacent first and second components each having a main gas path facing surface within an engine casing, an inter component cavity located between the first and second components on the outboard side of the main gas path; an axial restrictor located within the inter component cavity for axially restricting movement of the first or second component relative to either or both of the other of the first and second component or the engine casing, wherein the axial restrictor is radially located in the engine casing or other of the first and second component and includes a radially facing surface; a retaining element, comprising a main body having a circumferential length extending around the gas turbine engine and an axial length which extends between axially adjacent first and second components when in use; and, an obstructing portion located between the radially facing surface of the axial restrictor and an opposing second radial surface of the other of the first or second component or engine casing, so as to restrict the radial movement of the axial restrictor, in use.

The axial restrictor may be located in a radially extending slot. The slot may be located in the engine casing. The axial restrictor may be a retaining ring or shear key. The main body may be annular. Alternatively, the main body may be one of a plurality of arcuate components which are assembled into a ring set. The axial length of the retaining element and or main body may be less than the distance between the axially adjacent components. Thus, the retaining element may be separated by a distance from the axially adjacent components at either or both ends. The separation may be predetermined by the expected in use thermal expansion and or expected relative axial movement of the axially adjacent components. The obstructing portion may reside loosely in between the radially opposing surfaces during cold or non-use conditions. The axially adjacent components may be located within the turbine. The turbine may be the intermediate pressure turbine. The axially adjacent components may be a seal segment and a nozzle guide vane.

The axial restrictor may have a radial component which is received within a corresponding slot in the engine to provide an axial facing surface which abuts the first or second component to provide a shear axial restraint for the first or second component.

The main body may include one or more corrugations along the axial length thereof.

The corrugations may be undulations along the axial length of the main body. The corrugations may be defined by one or more peak or trough. The undulations may be curved in the axial and radial directions.

The corrugations may include one or more flat-topped peaks and or troughs.

The undulations may be substantially square sided in section. The walls of the undulations may comprise separate axially and radially extending portions. The separate axially and radially extending portions may be orthogonal to one another in section.

The obstructing portion may be provided by a peak or trough of one of the corrugations.

The obstructing portion may include an axially extending platform to provide a radially facing obstruction against which the axial restrictor can rest in use, wherein the platform is provided on or by a flat topped peak of a corrugation.

The platform may be formed by a separate component which is fixedly attached or joined to the main body.

The main body may include a plurality of openings to allow air to flow through the retaining element.

The openings may define circumferentially spaced legs in one or more of the undulations or corrugations of the main body. The flow of air may reduce or prevent a pressure gradient across the component in use. Alternatively, the airflow may be metered to provide a desired or predetermined pressure gradient or flow of air.

The retaining element further comprises an anti-fret portion which includes a limb which extends from the main body and is frictionally engaged between either or both of the first and second component and engine casing.

The limb may be a flange. The flange may be axially extending. The axially extending flange may be attached to the main body via a radial arm. The anti-fret portion may be radially outwards of the main body. The flange may extend in a circumferential direction at a constant radius relative to the principal axis of rotation. The anti-fret portion may be located between corresponding surfaces of the first and second component and engine casing which may experience relative movement as a result of vibration and or thermal expansion during use.

The retaining element may be axially and radially restrained by the anti-fret portion.

The gas turbine engine may further comprise a sealing element which is located between the first and second component within a sealing cavity, wherein the retaining element bounds one side of the sealing cavity.

The retaining element may bound the sealing cavity so as to prevent the seal moving outside of the sealing cavity when the engine is not in use.

The retention element may be is an assembly of parts comprising one or more of the main body, platform and anti-fret portion.

The parts may be pre-fabricated prior to assembly. The assembly may include joining the parts integrally together using a spot welding or brazing for example.

The platform may be one of the assembled parts and defines the axial extent of the retaining element at one end thereof.

A free end of the platform may be proximate to or abut one of the axially adjacent components in use. There may be a predetermined separation between the free end and proximate component. The separation may be determined by the expected thermal expansion on the retaining element or associated components.

A retaining element for radially locating an axial restrictor in a gas turbine engine comprise: a main body having a circumferential length extending around the gas turbine engine and an axial length which extends between axially adjacent first and second components when in use; and, an obstructing portion located between the radially facing surface of the axial restrictor and an opposing second radial surface of the other of the first or second component or engine casing, so as to restrict the radial movement of the axial restrictor, in use.

The main body may include one or more corrugations along the axial length thereof.

The corrugations include one or more flat-topped peaks and or troughs.

The obstructing portion is provided by one of the corrugations.

The obstructing portion includes a platform against which the retaining ring rests in use, wherein the platform is provided on or by a flat topped peak of a corrugation.

The main body includes an anti-fret portion which extends from the main body for frictional engagement between two components of the gas turbine engine which experience relative movement in use.

The main body includes a plurality of openings to allow air to flow through the retaining element.

The obstructing portion comprises a plurality of circumferentially spaced leg portions.

The retention element is an assembly of parts comprising one or more of the main body, leg portion, platform and anti-fret portion.

The platform is one of the assembled parts and defines the axial extent of the retaining element at one end thereof.

DESCRIPTION OF DRAWINGS

Embodiments of the invention will now be described with the aid of the following drawings of which.

DETAILED DESCRIPTION OF INVENTION

Figure 1:
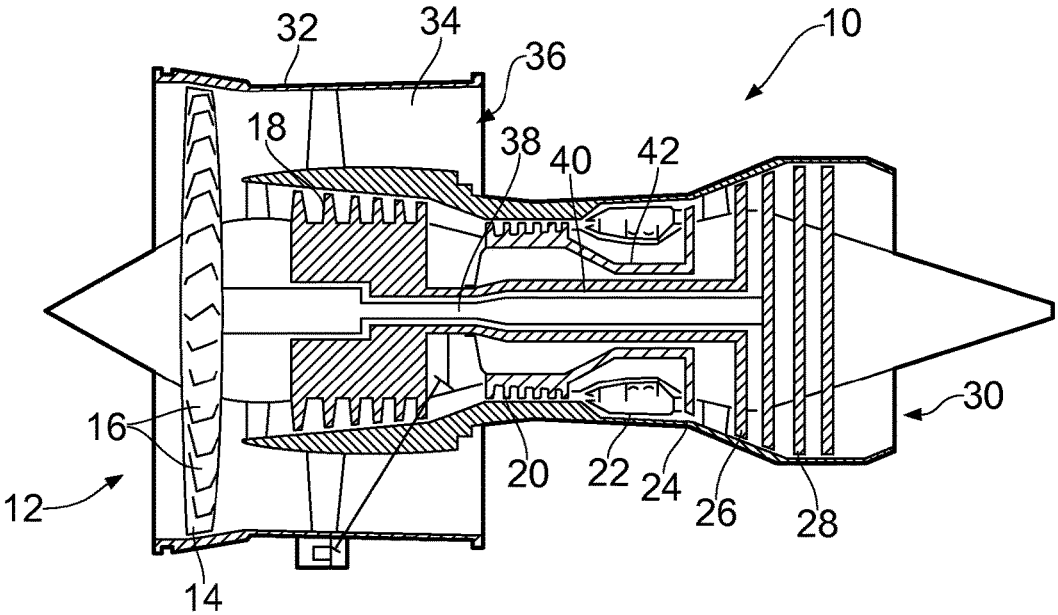
FIG. 1 shows a conventional gas turbine engine to which the invention can be applied.
Figure 2:
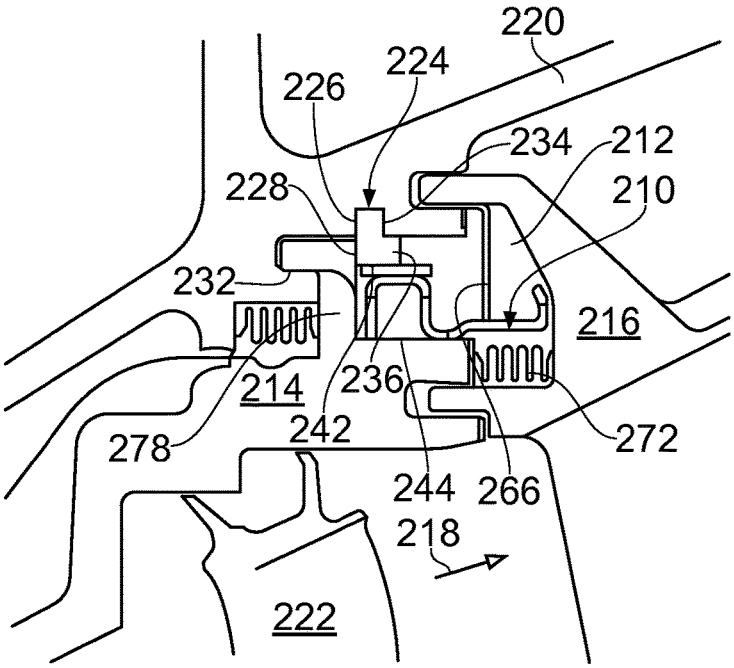
FIG. 2 shows a section of an intermediate pressure turbine which accommodates the retaining element of the invention.
Figure 3:
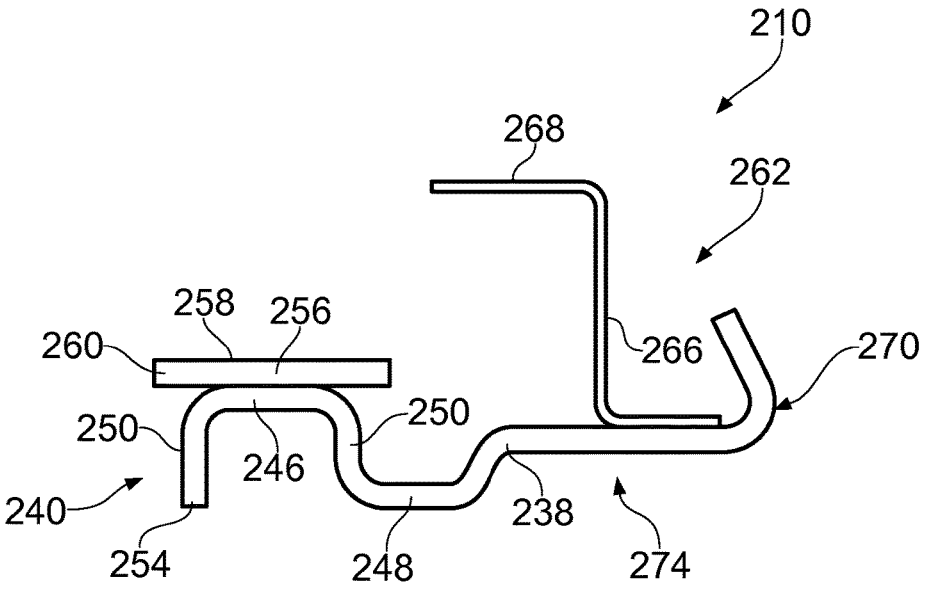
FIG. 3 shows a section of the retaining element.
Figure 4:
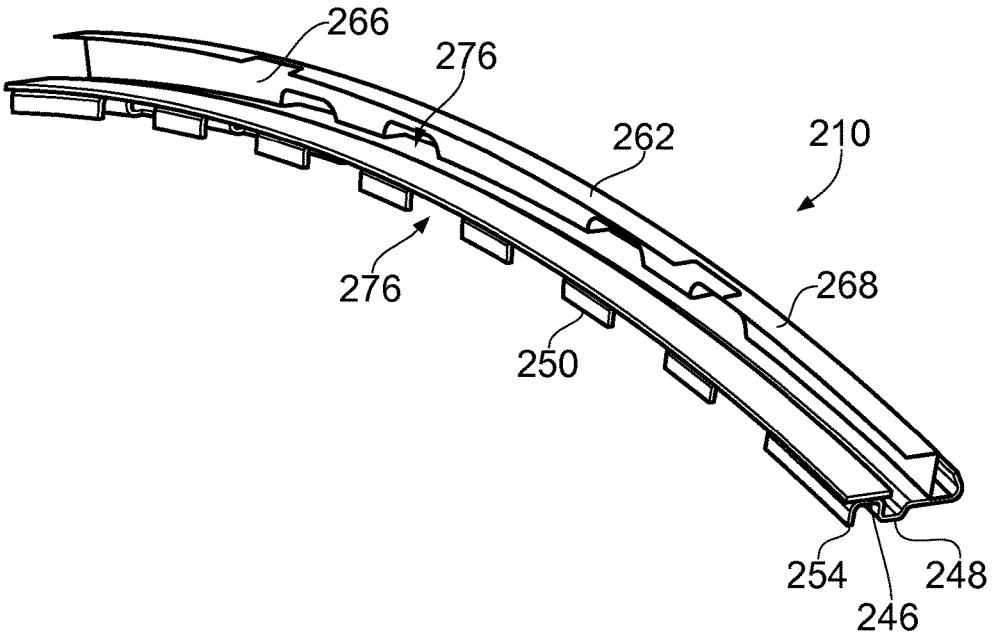
FIG. 4 shows a perspective view of the retaining element.

FIGS. 2, 3 and 4 show a retaining element 210 according to the present invention. The retaining element 210 of the described embodiment is located in the intermediate pressure turbine of a gas turbine engine. More specifically, the retaining element 210 is located in an inter-component cavity 212 between axially adjacent first 214 and second 216 components in the intermediate pressure turbine. The first component 214 is a seal segment, which is located outboard of and bounds the main gas path 218 around a rotating turbine blade 222, and the second component 216 is the downstream nozzle guide vane, NGV. It will be appreciated that the axially adjacent components may be other components not associated with the intermediate pressure turbine of a gas turbine engine.

The seal segment 214 and the NGV 216 need to be axially restrained with respect to the engine casing 220 and other engine components so as to preserve the required relative spacing of the components during operation of the engine 10. In the arrangement shown in FIG. 2, the axial location of the upstream seal segment 214 is achieved using an axial restrictor in the form of a retaining ring 224 which is received within a corresponding annular recess 226 in the engine casing 220 so as to project radially inwardly into the inter-component cavity 212. An upstream facing surface 228 of the retaining ring 224 abuts an opposing surface 232 of the seal segment 214 so as to provide axial restraint to the seal segment.

The retaining ring 224 is of annular construction with a radial component 234 and an axial component 236 which are joined so as to provide an L-shape section. The retaining ring 224 is in the form of a split ring of which the radial component 234, or arm, is inserted into the corresponding annular groove of the engine casing, with axial component 236 providing lateral stiffness to the ring 224. To prevent thermal and centrifugal movement and general operating vibration working the retaining ring 224 loose and ejecting into the cavity 212, it is necessary to provide an obstruction radially inwards of the retaining ring 224.

The retaining element 210 of the present invention includes a main body 238 having a circumferential length extending around the gas turbine engine 10. As can be seen from FIG. 4, the retaining element 210 of the described embodiment is of an arcuate construction. However, the circumferential length may provide a complete annulus where the engine architecture allows it. It will be appreciated that where the components are arcuate, there will be a plurality of similar components which will cooperate with each other to provide a ring set which encircles the engine 10.

The main body 238 has an axial length which extends between axially adjacent seal segment 214 and NGV 216. An obstructing portion 240 forms part of the main body 238 and is located between two radially opposing surfaces. The radially opposing surfaces are provided by a radially inner surface 242 of the retaining ring 224 and an opposing surface 244 of the seal segment 214. Hence, the obstructing portion 240 is located within the space radially inwards of the retaining ring 224 and prevents the movement of the retaining ring 224 radially inwards into the inter-component cavity 212. It will be appreciated that some movement of the retaining ring 224 can and should be tolerated to allow for the various necessary expansions and contractions which occur during operation of the engine 10 when in use. Thus, the obstructing portion 240 is loosely received between the opposing radial surfaces 242, 244 with a minimum combined clearance on each radial side.

The radial clearance will depend on the engine architecture but will typically be around 0.065% of the engine radius The main body 238 has a corrugated construction which includes one or more corrugations having axially spaced peaks 246 and troughs 248 which extend in a circumferential direction. The corrugations provide torsional stiffness to the retaining element 210 with the peaks 246 and troughs 248 being radially located to provide supporting surfaces for the obstructing portion 240.

In the described embodiment, there is a single corrugation having a radially inner trough 248 downstream of a radially outer peak 246. The undulating profile of the corrugation includes orthogonally extending radial and axial components which are joined at respective ends by curved portions. Thus, the peak 246 and trough 248 are flat and each extends between two radially extending portions or legs 250. The radially outer peak 246 provides a support surface for the retaining ring 224 with the radially inner trough 248 providing a location platform which resides against an opposing surface 244 of the seal segment 214.

The upstream end of the radially outer peak terminates in an arm having a free end 254 which is located in the same radial plane as the trough peak 246. Thus, the supporting surface of the obstructing portion 240 has an open sided box-like construction when viewed in section, with two radially extending portions or legs 250 with the flat topped peak there between 246.

The main body 238 additionally includes a support platform 256 which is located radially inwards of the retaining ring 224 on the support surface 258 of the obstructing portion 240. The support platform 256 is in the form of a band of metal which axially extends parallel the rotational axis of the engine to provide a platform 256 which corresponds to the radially inner surface of the retaining ring 224. The support platform 256 thus provides the contacting surface between the retaining element 210 and the retaining ring 224.

The support platform 256 extends axially beyond the terminal end of the corrugated structure and free end 254 so as to provide an end 260 which abuts a surface of the seal segment 214, thereby limiting the amount of upstream axial movement which can be experienced by the retaining element 210 in use. Thus, the supporting platform 256 defines the axial length of the retaining element in part.

The retaining element 210 also includes an anti-fret device 262 which extends radially outwards from the main body 238 at a mid-portion thereof and provides an axially extending anti-fret portion 268 between two opposing and frictionally engaging surfaces of the casing circumferential groove 220 and NGV 216. In the described embodiment, the anti-fret device 262 is constructed from a radially extending limb 266 having an axially extending flange 268 which provides the liner located between the two engine components.

The downstream end of the main body includes free end 270 which extends radially outwards and is axially inclined at an angle of approximately 20 degrees from the normal of the principal rotational axis of the engine. The angle of the inclination matches the corresponding opposing surface of the NGV 216 such that the separating gap is substantially uniform along the length of the free end. The upturned free end 270 provides torsional rigidity to the downstream end of the retaining element.

A third function of the retaining element 210 is to define a space for a flexible seal 272 which is located between the seal segment 214 and NGV 216. The seal segment 214 and NGV 216 provide a boundary wall for the main gas flow path 218 within the turbine. In order to prevent ingestion of the hot gas outboard of the boundary wall, cooling air is provided on the outboard side of the components at a higher pressure than that in the main gas path 218. To help prevent the positive pressure cooling air bleeding into the main gas path, sealing arrangements are provided at various location along the length of the turbine, particularly at the interfaces between the axially adjacent components.

Hence, as shown in FIG. 2, there is a W-seal 272 located in a sealing cavity provided by a recess created in a downstream end of the seal segment 214, and an opposing upstream end of the NGV 216 platform. The seal 272 comprises a corrugated structure having a plurality of peaks and troughs evenly distributed along its axial length. The seal is designed to be loosely fitting in a cold build state and axially compressible under hot running conditions so that it can seal ably accommodate the full relative axial deflection of the seal segment 214 and NGV 216.

The retaining element 210 aids the cold loose fit of the W-seal 272 by providing a restriction or cap to the sealing cavity so as to bound it. The restriction is provided by an axially extending mid-portion 274 of the retaining element 210, the amount the seal 272 can fall under gravity when the engine is cold is limited and the sealing surfaces of the W-seal which mate with the gas path components remains in place. The mid-portion may be additionally defined as being between two contacting points of the main body 238 which span the sealing element 272 and abut or are in a closed spaced relation to the seal segment 214 and NGV 216. Thus, the contacting points provide additional sealing surfaces in use to further aid the sealing function. In the described embodiment, the two contacting points are provided by the flat trough portion of the undulation, and the free end 270 which sits proximate to the NGV 216 platform.

FIG. 4 shows a perspective view of a retaining element 210 of that shown in FIGS. 2 and 3 with the benefit of showing openings 276 along the circumferential length of the structure. The openings 276 provide a fluid pathway for cooling air to flow through, thus reducing or removing any pressure differential across the retaining element 210 which, in the present embodiment, is provided to carry out a structural role only.

The openings 276 are provided in each radially extending component. Thus, there are evenly circumferentially spaced openings in each of the radially extending portions or legs 250 of the obstructing portion 240, thereby providing a plurality of arms along the circumferential length. In the embodiment, the openings 276 are provided with the same arcuate length of the openings. Openings are also provided along the circumferential length of the radial arm of the anti-fret device 262. These openings are grouped in pairs, with the centre line of each pair being approximately a third of the way along the circumferential extent of the retaining element 210. This spacing size and pitching is sufficient to achieve pressure equalization yet maintain the limb 266 structural integrity. The pitching is designed to match the NGV 216 pitching rather than the segment 214.

In use, cooling air flows into the inter-component cavity via a controlling cooling hole (not shown) provided in support flange 278 of the seal segment 214 and around the support flange 278 and birds-mouth coupling. From there, the air travels downstream and on to the radially outer and inner sides of the main body via the openings 276 in the obstructing portion 240. An amount of cooling air travels downstream over the W-seal 272 and around the inclined free end. The remaining air travels through the openings in the anti-fret liner before being exhausted downstream in apertures provided in the body of the NGV (not shown).

The retaining element 210 is an assembly of multiple parts which are joined together to provide a unified or integrally connected structure. This allows simplicity in construction, and the different parts to be made of different material or stock. The separate components of the described embodiment are the main body 238 which incorporates a portion of the obstructing portion 240, the support platform 256 and the anti-fret liner 262. It will be noted that the anti-fret liner 262 is made from thinner stock than the main body 238 as the structural rigidity required of this component is reduced.

The components are pre-fabricated using conventional methods before being joined with an appropriate method for the operating conditions. In the case of the low pressure turbine and the associated temperature, suitable joining methods include brazing and spot welding.

To build the engine with the retaining element 210, the seal segments 214 are located against the engine casing 220 prior to the insertion of the retaining ring 224. The retaining element 210 is then located before the W-seal 272 and NGVs.

The retaining element 210 of the present invention fulfils three functional requirements using a sheet material which is lightweight. The multifunction ability of the retaining element can allow the bulk of the cast components to be reduced. In doing so, it allows the outboard mass of the cast components to be reduced, thereby providing the cavity in which the retaining element resides.

Although the described embodiment relates to the intermediate pressure turbine section of the gas turbine engine, the invention may find application in other areas stages of the turbine. For example, high or low pressure turbine sections, or compressor sections.

Further, although the described embodiment provides the three functions, it will be appreciated that this need not be the case and a similar retaining element may provide one or more of the functions only. Hence, the retaining element 210 may provide the obstruction to the removal of the axial restrictor for example. Further, the specific configuration of the retaining element may be different to that described. For example, the main body 238 may include more or less undulations or corrugations than shown. Further, the corrugations may be continuously curving such as a sinusoid. Further, the axial restrictor may be integrally formed with the retaining element. The above described embodiment should be taken as an example of a broader inventive concept defined by the scope of the appended claims.

The invention claimed is:

1. A gas turbine engine comprising:

axially adjacent first and second components each having a main gas path facing surface within an engine casing, an inter component cavity located between the first and second components on an outboard side of a main gas path;

an axial restrictor located within the inter component cavity for axially restricting movement of the first component relative to either of the second component or the engine casing, wherein the axial restrictor is radially located in the engine casing or the second component and includes a radially facing surface; and a retaining element, comprising:

a main body having a circumferential length extending around the gas turbine engine and an axial length which extends between the axially adjacent first and second components when in use; and an obstructing portion located between the radially facing surface of the axial restrictor and an opposing second radial surface of the second component or the engine casing, so as to restrict the radial movement of the axial restrictor, in use, wherein the axial restrictor is separate from the engine casing and has a radial component which is received within a corresponding slot in the engine casing to provide an axial facing surface which abuts the first component or the second component to provide a shear axial restraint for the first component or the second component.

2. The turbine engine according to claim 1, wherein the main body includes one or more corrugations along the axial length thereof.

3. The turbine engine as claimed in claim 2, wherein the one or more corrugations include one or more flat-topped peaks or troughs.

4. The gas turbine engine as claimed in claim 2, wherein the obstructing portion is provided by a peak or trough of one of the one or more corrugations.

5. The gas turbine engine as claimed in claim 2, wherein the obstructing portion includes an axially extending platform to provide a radially facing obstruction against which the axial restrictor can rest in use, wherein the platform is provided on a corrugation of the one or more corrugations.

6. The gas turbine engine as claimed in claim 1, wherein the main body includes a plurality of openings to allow air to flow through the retaining element.

7. The gas turbine engine as claimed in claim 1, in which the retaining element further comprises an anti-fret portion which includes a limb which extends from the main body and is frictionally engaged between either or both of the first and second component and engine casing.

8. The gas turbine engine as claimed in claim 7 in which the retaining element is axially and radially restrained by the anti-fret portion.

9. The gas turbine engine as claimed in claim 1 further comprising a sealing element which is located between the first and second component within a sealing cavity, wherein the retaining element bounds one side of the sealing cavity.

10. The gas turbine engine as claimed in claim 1, wherein the retaining element is an assembly of parts comprising one or more of the main body, platform and anti-fret portion.

11. The gas turbine engine as claimed in claim 10, wherein the platform is one of the assembled parts and defines the axial extent of the retaining element at one end thereof.

12. A retaining element for radially locating an axial restrictor in a gas turbine engine, the retaining element comprising:

a main body having a circumferential length extending around the gas turbine engine and an axial length which extends between axially adjacent first and second components when in use; and an obstructing portion located between a radially facing surface of the axial restrictor and an opposing second radial surface of the second component or an engine casing, so as to restrict the radial movement of the axial restrictor, in use, wherein the main body includes one or more corrugations along the axial length thereof, and wherein the obstructing portion includes an axially extending platform to provide a radially facing obstruction against which the axial restrictor can rest in use, wherein the platform is provided on a flat topped peak of a corrugation of the one or more corrugations.

13. The retaining element as claimed in claim 12, wherein the main body includes a plurality of openings to allow air to flow through the retaining element.

14. The retaining element as claimed in claim 12, in which the retaining element further comprises an anti-fret portion which includes a limb which extends from the main body and is frictionally engaged between either or both of the first and second component and engine casing.

15. The retaining element as claimed in claim 14 in which the retaining element is axially and radially restrained by the anti-fret portion.

* * * * *